US008545282B1

(12) United States Patent
DeFilippo

(10) Patent No.: US 8,545,282 B1
(45) Date of Patent: Oct. 1, 2013

(54) AIR BUBBLE OPERATED UNDERWATER ORNAMENT KIT

(76) Inventor: Paul DeFilippo, Ozone Park, NY (US)

( * ) Notice: Subject to any disclaimer, the term of this patent is extended or adjusted under 35 U.S.C. 154(b) by 461 days.

(21) Appl. No.: 12/963,825

(22) Filed: Dec. 9, 2010

(51) Int. Cl.
*A63H 23/00* (2006.01)
*A63H 13/18* (2006.01)
*A63H 17/00* (2006.01)

(52) U.S. Cl.
USPC ..... 446/156; 446/396; 446/440

(58) Field of Classification Search
USPC ..... 446/153, 156, 159, 176, 396, 440; 119/254, 263; 40/406, 407, 411, 412, 439, 40/477; D30/106
See application file for complete search history.

(56) References Cited

U.S. PATENT DOCUMENTS 1,893,507 A * 1/1933 Leo Ranney ..... 446/156
3,265,388 A * 8/1966 Kane, Jr. ..... 472/67
3,326,184 A * 6/1967 Greenbaum ..... 119/263
3,524,430 A * 8/1970 Willinger ..... 119/263
3,548,786 A * 12/1970 Willinger ..... 119/254
3,773,015 A * 11/1973 Cruickshank et al. ..... 119/254
3,929,102 A * 12/1975 Suchowski et al. ..... 119/254
4,082,063 A * 4/1978 Strickland ..... 119/254
4,122,627 A * 10/1978 Kubiatowicz ..... 446/156
4,309,841 A * 1/1982 Asano ..... 446/440
D275,505 S 9/1984 Takasaka
4,728,420 A * 3/1988 Abercia, Jr. ..... 210/167.24
5,476,068 A * 12/1995 Townsend ..... 119/256
D389,536 S 1/1998 Mira Verdu
D400,312 S 10/1998 Wing
6,385,880 B1 * 5/2002 Naragon ..... 40/406
D554,809 S * 11/2007 Ragonetti et al. ..... D30/106
D566,905 S 4/2008 Ragonetti et al.
2008/0092824 A1 * 4/2008 Levin ..... 119/253

* cited by examiner

*Primary Examiner* — Gene Kim
*Assistant Examiner* — Alyssa Hylinski

(57) ABSTRACT

An air bubble operated underwater ornament kit including components for installing an air bubble operated underwater ornament for an aquarium. The kit provides a base, an air supply tube to form air bubbles in the water, and various ornament bodies having respective movement bodies that move upon release of the air bubbles toward each movement body, which include a skeleton riding a motorcycle having a motorcycle underside for a movement body whereby a front wheel of the motorcycle rises; a pair of opposing skeletons with one skeleton having a hand attached to a barrel disposed therebetween for a movement body whereby one skeleton rises and moves toward the other skeleton; and a motorcycle having a rear wheel with blades radially disposed on a tire thereof for a movement body whereby the tire spins.

1 Claim, 6 Drawing Sheets

AIR BUBBLE OPERATED UNDERWATER ORNAMENT KIT

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of underwater ornaments are provided for aquariums. However, what is needed is a kit that provides components for installing an air bubble operated underwater ornament for an aquarium.

FIELD OF THE INVENTION

The present invention relates to underwater ornaments, and more particularly, to an air bubble operated underwater ornament.

SUMMARY OF THE INVENTION

The general purpose of the present air bubble operated underwater ornament, described subsequently in greater detail, is to provide an air bubble operated underwater ornament which has many novel features that result in an air bubble operated underwater ornament which is not anticipated, rendered obvious, suggested, or even implied by prior art, either alone or in combination thereof.

To accomplish this, the present air bubble operated underwater ornament kit includes a base disposed in an upright position under water. An air supply tube is disposed through an internal cavity of the base. A receiver member, having an opening on a upper side thereof, is disposed over the air supply tube internal end. A plurality of air bubbles is distributed through the air supply tube through the receiver member opening. An ornament body, having a least one movement member, is disposed atop the base. A dome-shaped cap is removably disposed over the receiver member opening. The cap has an open raised position and an alternate closed lowered position. Upon the release of the air bubbles from the air supply tube into the cap interior cavity, the cap is in the open raised position. Upon the non-release of the air bubbles from the air supply tube into the cap interior cavity, the cap is in the closed lowered position. The cap top end is attached to the movement member. The ornament body is provided in three forms. One ornament body is a motorcycle ridden by a skeleton and a respective movement member is a forward pipe attached to the motorcycle underside. Upon the release of the air bubbles from the air supply tube into the cap interior cavity, the forward pipe rises and the pivoting axle pivots upwardly whereby a front wheel of the motorcycle rises. The rising movement of the front wheel simulates the performance of a "popping a wheelie" by the skeleton. An alternate ornament body is a pair of skeletons consisting of a first skeleton and a second skeleton disposed on each side of a barrel. The first skeleton has a first hand and a pair of knees while the second skeleton has a second hand attached to the cap top end. The second hand is attached to a first arm.which is attached to a swivel point disposed within the second skeleton. A second arm of the skeleton has one end attached to the swivel point and a second end attached to a swivel rod disposed within an upper torso of the first skeleton. A ring is disposed proximal to each first skeleton knee. A swivel joint is disposed in a hip of the first skeleton. The respective movement member is the second hand. Upon the release of the air bubbles into the cap interior cavity, the second hand and first arm of the second skeleton rise, the second skeleton second arm rises upon the rising the of the first arm, the first skeleton rises and moves toward the second skeleton upon the rising of the second arm, while the knees and hip of the first skeleton move. The movement of the first skeleton toward the second skeleton simulates a fight between the first skeleton and the second skeleton for viewers' entertainment. Another ornament body is alternately a motorcycle ridden by a skeleton having a dagger in a hand thereof. A stand is attached to the base top side proximal to the front side. A front wheel of the motorcycle is attached to the stand. A rear wheel of the motorcycle has a tire disposed on a rim thereof. The rim is spinningly attached to a rod disposed on a central horizontal axis of the rear wheel. The respective movement member is a plurality of spaced-apart parallelepiped blades radially disposed on the tire by which the rear wheel spins upon the release of the air bubbles onto the blades. Marks on the tires visually enhance the spinning of the rear wheel.

Thus has been broadly outlined the more important features of the present air bubble operated underwater ornament and method so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
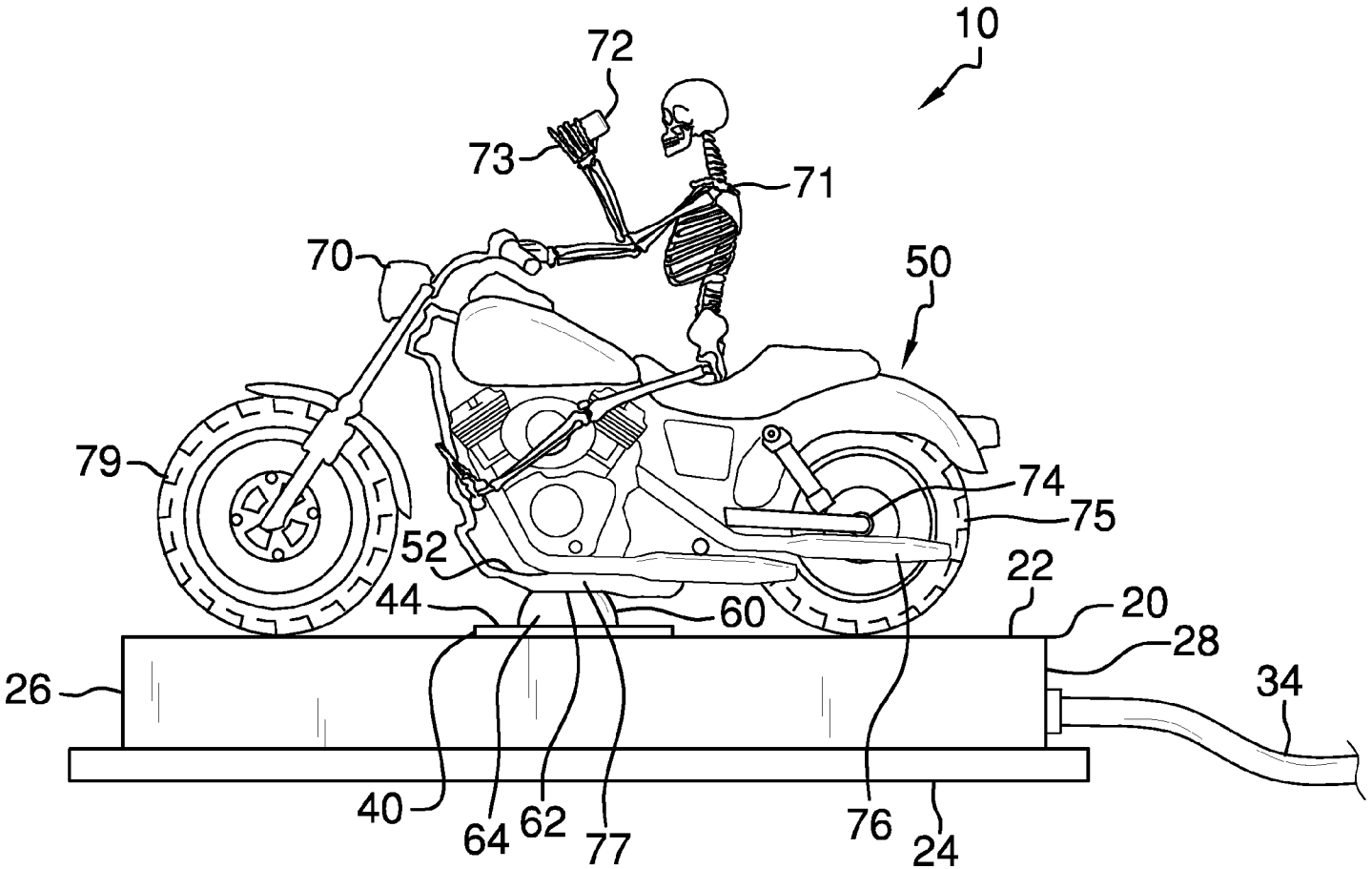
FIG. 1 is a side elevation view of an ornament body.

With reference now to the drawings, and in particular FIG. 1 through 6 thereof, the instant air bubble operated underwater ornament employing the principles and concepts of the present air bubble operated underwater ornament and generally designated by the reference number 10 will be described.

Referring to FIG. 1 through 6 a preferred embodiment of the present air bubble operated underwater ornament kit 10 is illustrated. The air bubble operated underwater ornament kit includes a base 20 having a top side 22, a bottom side 24, a front side 26, a rear side 28, and an internal cavity 32. The base 20 is disposed in an upright position under water. An air supply tube 34, which has an outer end 36 and an internal end 38, is disposed through the internal cavity 32. A receiver member 40 is disposed over the air supply tube 34 internal end 38. The receiver member 40 has an opening 42 disposed on an upper side 44 thereof. A plurality of air bubbles 110 is distributed through the air supply tube 34 through the receiver member 40 opening 42.

Figure 2:
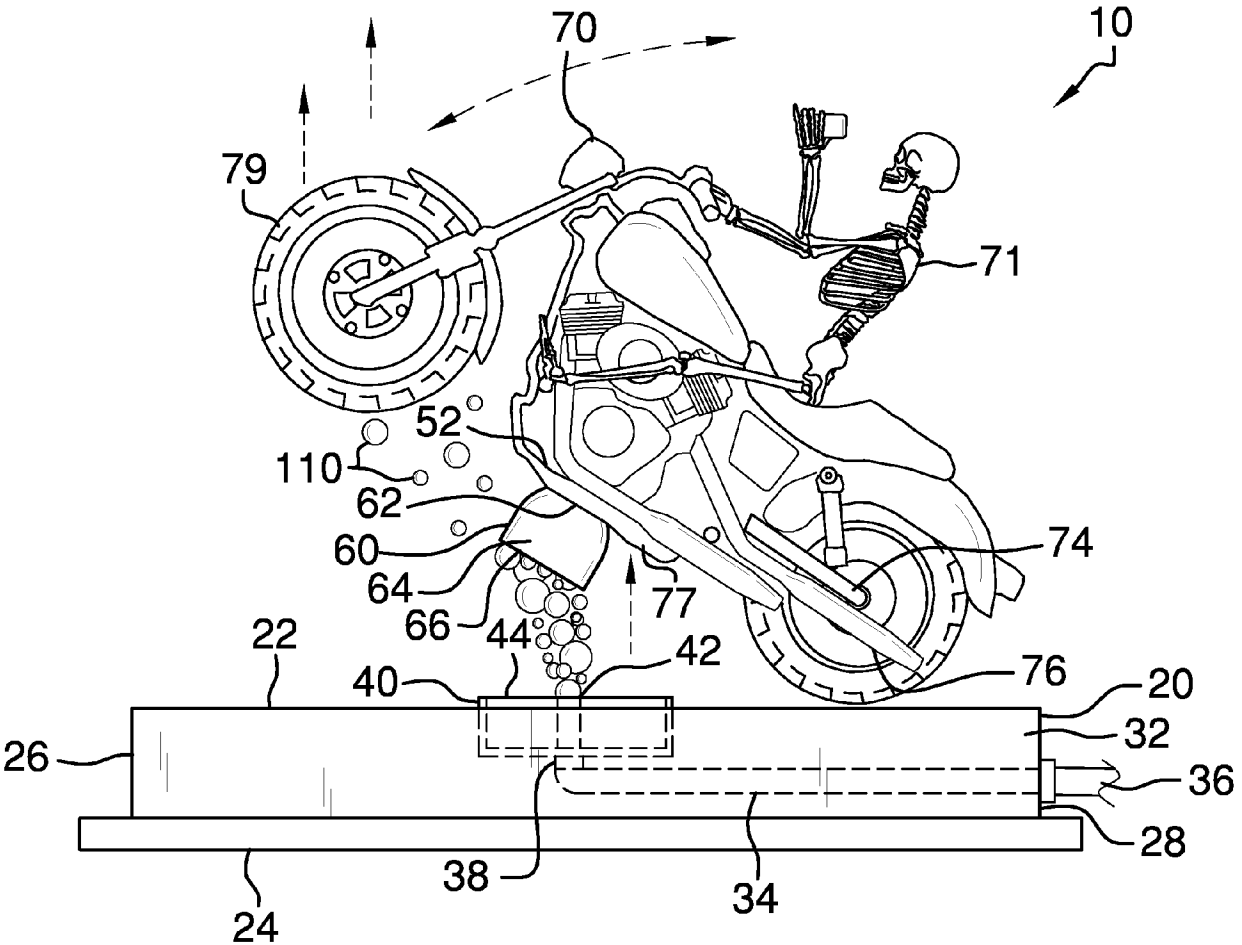
FIG. 2 is a side elevation view of the first ornament in a moved position.
Figure 3:
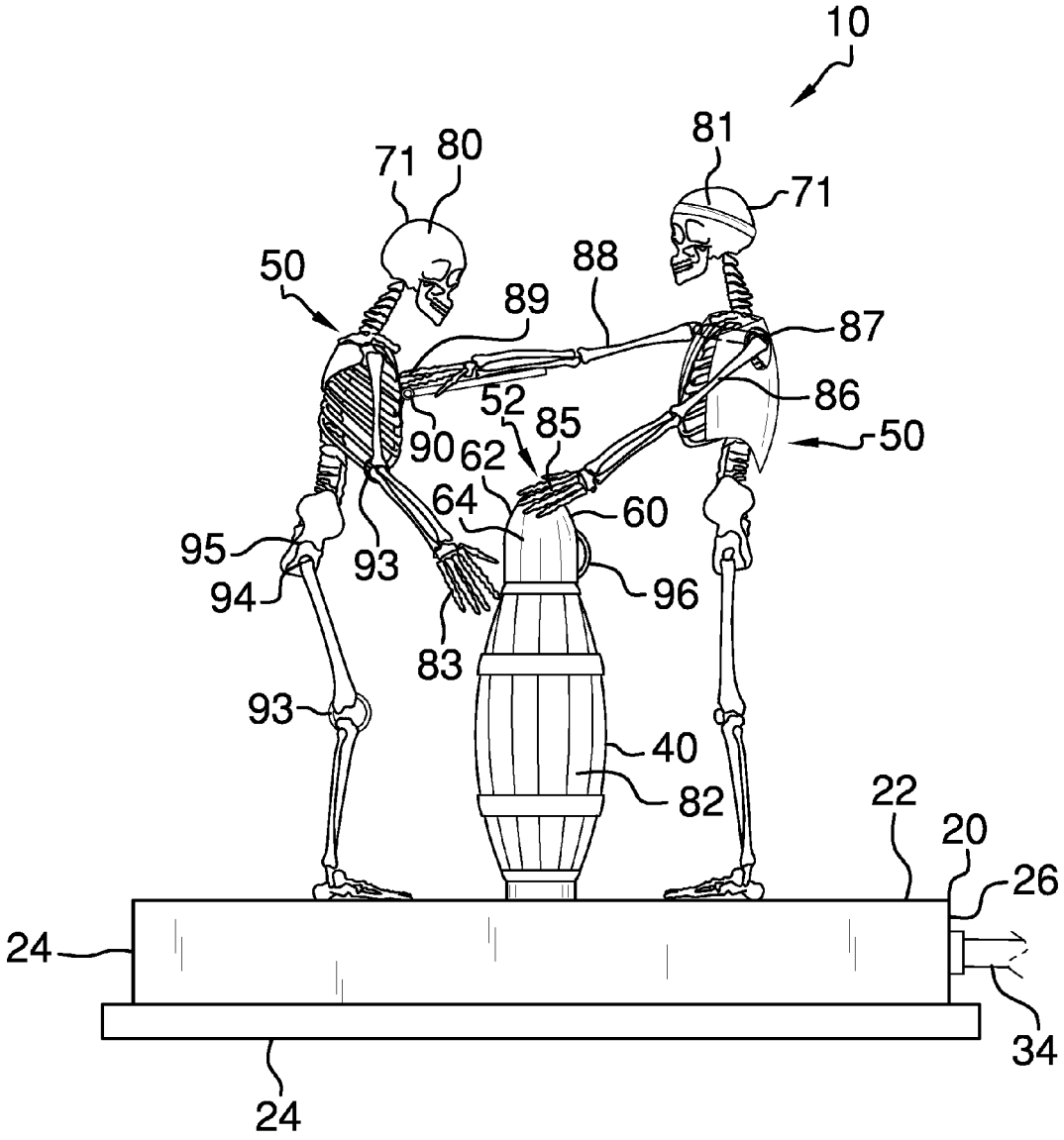
FIG. 3 is a side elevation view of an alternate ornament body.
Figure 4:
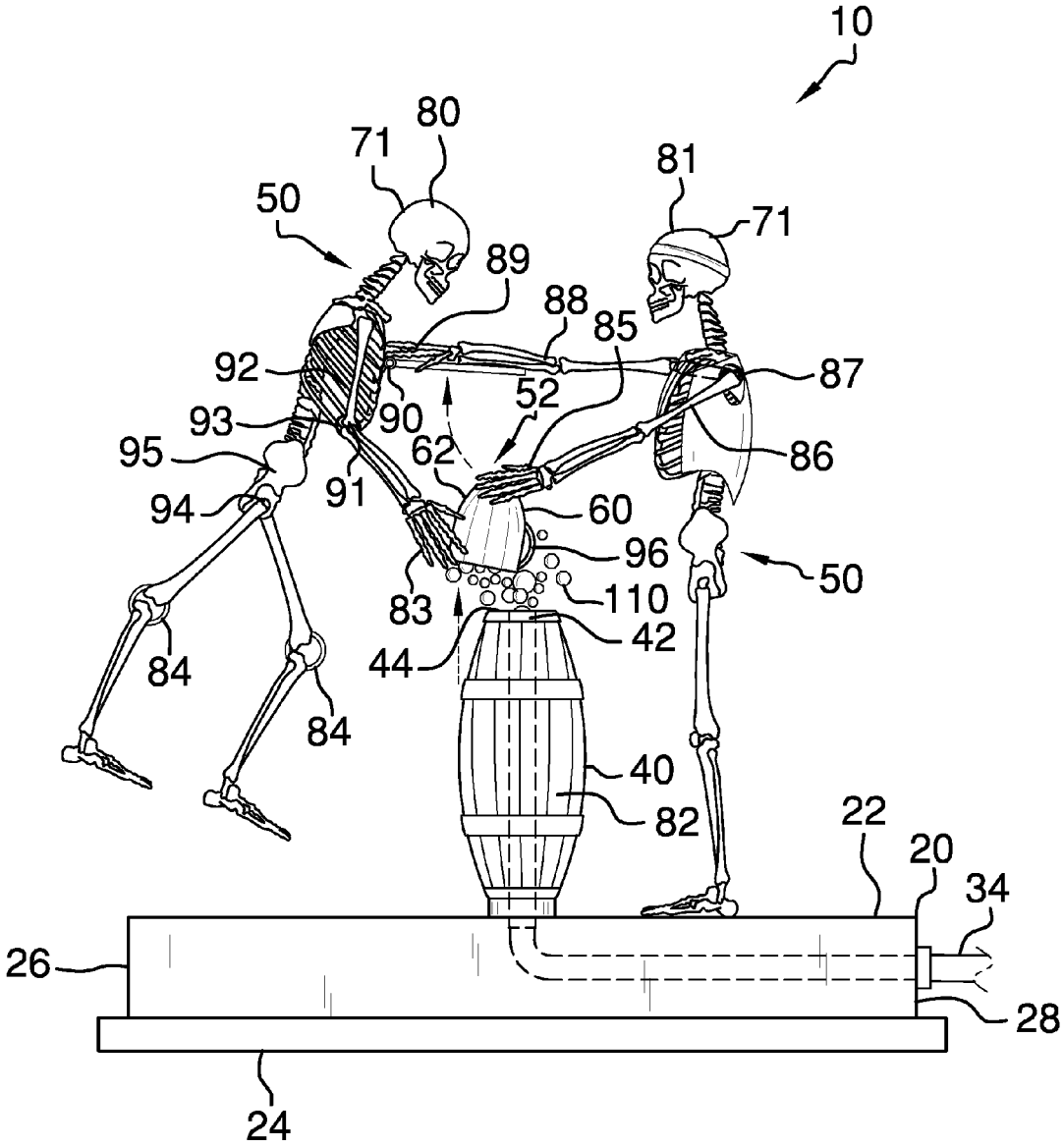
FIG. 4 is a side elevation view of a second ornament in a moved position.

An ornament body 50 is disposed atop the base 20. The ornament body 50 has at least one movement member 52. A dome-shaped cap 60 is removably disposed over the receiver member 40 opening 42. The cap 60 is in operational communication with the air supply tube 34. The cap 60 has a top end 62, a continuous external wall 64, and an interior cavity 66. The cap 60 has an open raised position, as shown in FIGS. 2 and 4, and an alternate closed lowered position, as shown in FIGS. 1 and 3. Upon the release of the air bubbles 110 from the air supply tube 34 into the cap 54 interior cavity 66, the cap 60 is in the open raised position. Upon the non-release of the air bubbles 110 from the air supply tube 34 into the cap 60 interior cavity 66, the cap 66 is in the closed lowered position. The cap 60 top end 62 is attached to the movement member 52.

The ornament body 50 is provided in three forms. One ornament body 50, which is illustrated in FIGS. 1 and 2, is a motorcycle 70 ridden by a skeleton 71 having a cup 72 in a hand 73 thereof. The motorcycle 70 has a pivoting axle 74 attached to a rear wheel 75 thereof. The pivoting axle 74 is disposed in a position parallel to a rear muffler 76 of the motorcycle 70. The respective movement member 52 is a forward pipe 77 attached to an underside 78 of the motorcycle 70. The cap 60 top end 62 is attached to the forward pipe Upon the release of the air bubbles 110 from the air supply tube 34 into the cap 60 interior cavity 66, the forward pipe 77 is raised and the pivoting axle 74 pivots upwardly whereby a front wheel 79 of the motorcycle 70 rises. The rising movement of the front wheel 79 simulates the performance of a "popping a wheelie" by the skeleton 71. Upon the non-release of the air bubbles 110 from the air supply tube 34 into the cap 60 interior cavity 66, the front wheel 79 of the motorcycle 70 lowers.

An alternate ornament body 50, illustrated in FIGS. 3 and 4, is a pair of skeletons 71 consisting of a first skeleton 80 and a second skeleton 81 disposed on each side of a barrel 82. The first skeleton 80 has a first hand 83 and a pair of knees 84. The second skeleton 81 has a second hand 85 attached to the top end 62 of the cap 60 which is disposed atop the barrel 82. The second hand 85 is attached to a first arm 86 end 86 which is attached to a swivel point 87 disposed within the second skeleton 81. A second arm 88 of the second skeleton 81 has one end attached to the swivel point 87 and a second end 89 attached to a swivel rod 90 disposed within an upper torso 92 of the first skeleton 80. The swivel rod 90 may be formed of brass. A ring 93 is disposed proximal to each first skeleton 80 knee 84 and at an elbow joint 91 proximal to the first hand 83. A swivel joint 94 is disposed in a hip 95 of the first skeleton 80. The movement member 52, as illustrated in FIGS. 3 and 4, is the second hand 85. Upon the release of the air bubbles 110 from the air supply tube 34 into the cap 60 interior cavity 66, the second hand 85 and first arm 86 rise, the second arm 88 rises upon the rising of the first arm 86, and first skeleton 80 rises and moves toward the second skeleton 81 upon the rising of the second arm 88, while the knees 84 and hip 95 of the first skeleton 80 move. The movement of the first skeleton 80 toward the second skeleton 81 simulates a fight between the first skeleton 80 and the second skeleton 81 for viewers' entertainment Upon the non-release of the air bubbles 110 from the air supply tube 34 into the cap 60 interior cavity 66, the first skeleton 80 lowers and moves away from the second skeleton into a standing position The cap 60 has a mug handle 96 disposed on the external wall 64 thereof.

Figure 5:
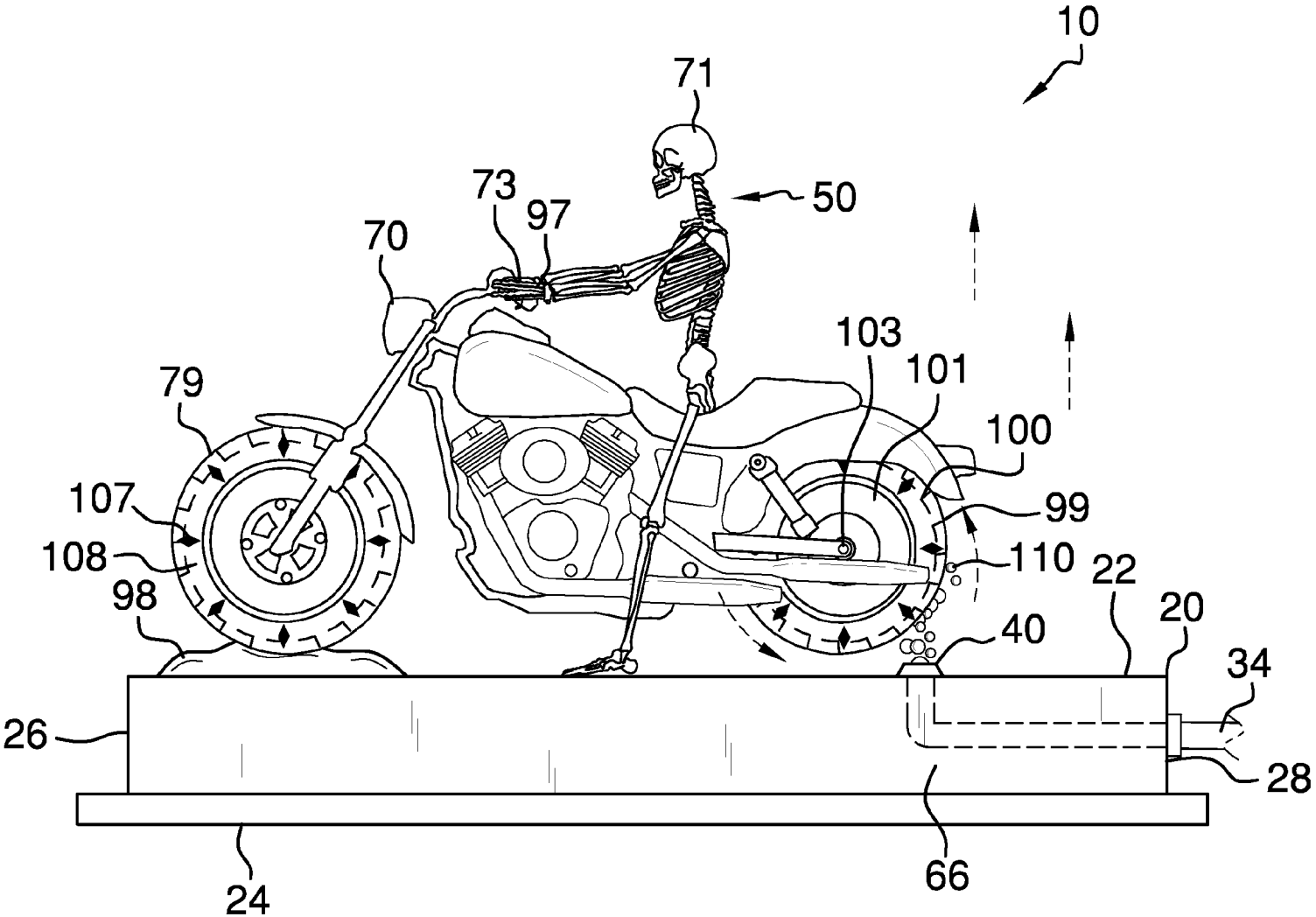
FIG. 5 is a side elevation view of a second alternate ornament body.
Figure 6:
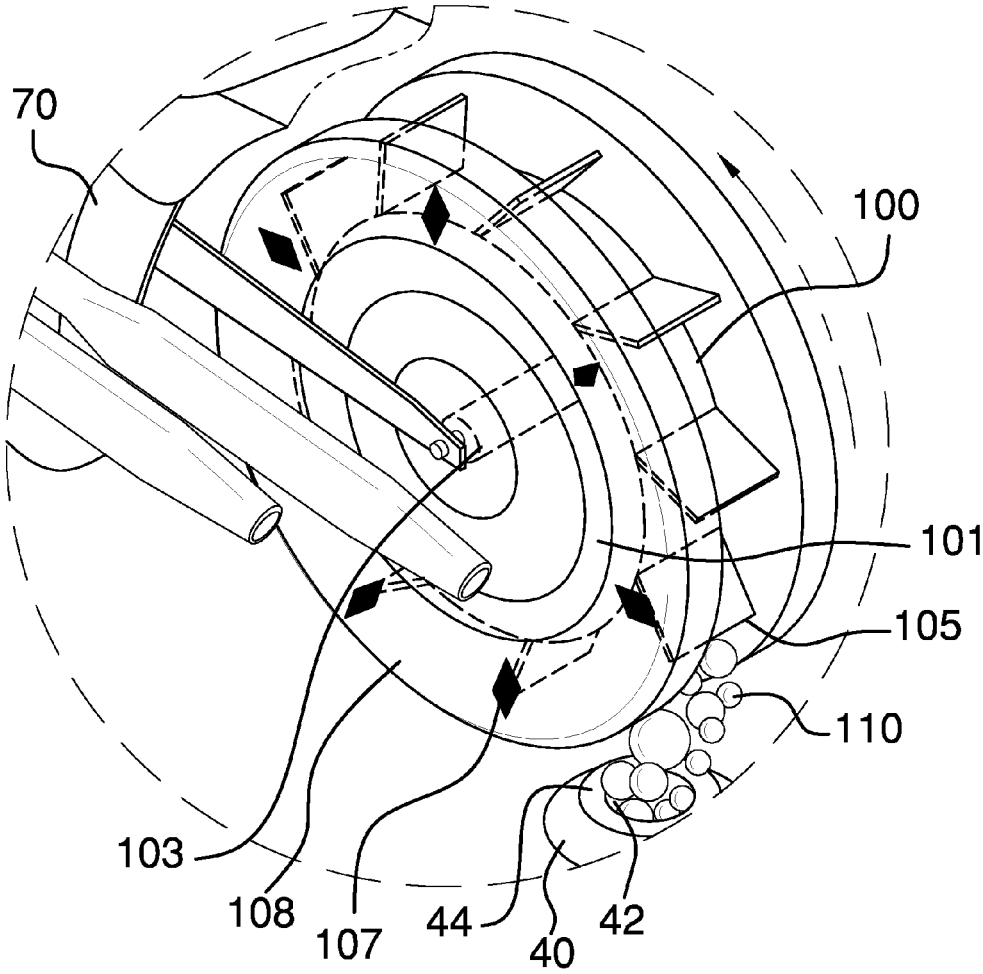
FIG. 6 is a detailed isometric view of a rear wheel.

Another ornament body 50, shown in FIGS. 5 and 6, is alternately a motorcycle 70 ridden by a skeleton 71 having a dagger 71 in a hand 73 thereof. A stand 98 is attached to the base 20 top side 22 proximal to the front side 24. A front wheel 79 of the motorcycle 70 is attached to the stand 98. A rear wheel 99 of the motorcycle 70 has a tire 100 disposed on a rim 101 thereof. The rim 101 is spinningly attached to a rod 103 disposed on a central horizontal axis of the rear wheel 99. As shown in FIGS. 5 and 6, the movement member is alternately a plurality of spaced-apart parallelepiped blades 105 radially disposed on the tire 100. Upon the release of the air bubbles 110 from the air supply tube 34 through the receiver member 40 opening 42, the air bubbles 110 sequentially engage the blades 105 whereby the rear wheel 99 spins.

A plurality of spaced-apart diamond-shaped marks 107 is radially disposed on an outer perimeter 108 of the tire 199 between the blades 105 for visual enhancement of the spinning of the rear wheel 99.

What is claimed is:

1. An air bubble operated underwater ornament kit consisting of:

a base having a top side, a bottom side, a front side, a rear side, and an internal cavity, the base disposed in an upright position under water;

an air supply tube disposed through the internal cavity, the air supply tube having an outer end and an internal end;

a receiver member disposed over the air supply tube internal end, the receiver member having an opening disposed on an upper side thereof, a plurality of air bubbles distributed through the air supply tube through the receiver member opening;

an ornament body disposed atop the base, the ornament body having at least one movement member;

a dome-shaped cap having a top end attached to the at least one movement member, a continuous external wall, and an interior cavity, the cap removably disposed over the receiver member opening;

wherein the cap is in operational communication with the air supply tube;

wherein the cap has an open raised position and an alternate closed lowered position, wherein upon the release of the air bubbles from the air supply tube into the cap interior cavity, the cap is in the open raised position;

wherein upon the non-release of the air bubbles from the air supply tube into the cap interior cavity, the cap is in the closed lowered position;

wherein the ornament body is a motorcycle ridden by a skeleton having a cup in a hand thereof;

wherein the motorcycle has a pivoting axle attached to a rear wheel thereof, the pivoting axle disposed in a position parallel to a rear muffler;

wherein the at least one movement member is a forward pipe attached to an underside of the motorcycle;

wherein the cap top end is attached to the forward pipe;

wherein upon the release of the air bubbles from the air supply tube into the cap interior cavity, the forward pipe rises and the pivoting axle pivots upwardly;

wherein upon the rising of the forward pipe and the pivoting of the pivoting axle, a front wheel of the motorcycle rises; and wherein upon the non-release of the air bubbles from the air supply tube into the cap interior cavity, the front wheel of the motorcycle lowers.

* * * * *